US005910192A

United States Patent [19]

Pulford, Jr. et al.

[11] Patent Number: 5,910,192

[45] Date of Patent: Jun. 8, 1999

[54] LOW-COST LINEAR POSITIONING DEVICE

[75] Inventors: Robert Pulford, Jr., Wolcott; Richard Donnelly, Wallingford; Brian Peterson, Woodbury, all of Conn.

[73] Assignee: Tri-Tech., Inc., Waterbury, Conn.

[21] Appl. No.: 08/925,189

[22] Filed: Sep. 8, 1997

Related U.S. Application Data

[63] Continuation of application No. 08/586,608, Jan. 16, 1996, abandoned.

[51] Int. Cl.[6] ..... G05G 11/00

[52] U.S. Cl. ..... 74/479.01; 74/471 XY; 74/89.15; 403/225

[58] Field of Search ..... 74/471 XY, 479.01, 74/490.09, 490.1, 509, 89.15; 403/223, 226, 227, 225

[56] References Cited

U.S. PATENT DOCUMENTS

| | | | |
|---|---|---|---|
| 4,804,290 | 2/1989 | Balseus | 403/225 |
| 5,061,039 | 10/1991 | Cassidy | 74/479.01 |
| 5,167,165 | 12/1992 | Brucher et al. | 74/479.01 |
| 5,319,990 | 6/1994 | Veale et al. | 74/89.15 |
| 5,398,780 | 3/1995 | Althof et al. | 74/89.15 |
| 5,499,547 | 3/1996 | Nagai et al. | 74/89.15 |
| 5,499,552 | 3/1996 | Yanagisawa | 74/471 X |
| 5,505,104 | 4/1996 | Takei | 74/490.09 |

FOREIGN PATENT DOCUMENTS

| | | | |
|---|---|---|---|
| 5-180297 | 7/1993 | Japan | 74/490.09 |

*Primary Examiner*—John A. Jeffery
*Assistant Examiner*—David Fenstermacher
*Attorney, Agent, or Firm*—John H. Crozier

[57] ABSTRACT

In a preferred embodiment, a linear positioning device, including: a frame member; an electric motor disposed to selectively move axially back and forth in the frame member; carriage apparatus attached to the electric motor; and apparatus to guide the motor in axial movement and to prevent radial movement thereof. In a further aspect of the invention, there is provided a frame for a linear positioning device, including: a horizontal base plate; vertical end plates for attachment to ends of the base plate; the base plate including a first groove defined in the surface thereof for the mounting therein of a guide rail for a moving member; and the base plate is cut from an extrusion which includes the first groove, without the machining thereof. In another aspect of the invention, there is provided, in a linear positioning device, having the front end plate of an electric motor as an end plate of the device. In an additional aspect of the invention, there is provided, in a positioning device, having an electric motor fixedly mounted to an end plate of the device.

7 Claims, 5 Drawing Sheets

LOW-COST LINEAR POSITIONING DEVICE

This application is a continuation of application Ser. No. 08/586,608, filed Jan. 16, 1996, now abandoned.

BACKGROUND OF THE INVENTION

1. Field of the Invention

The present invention relates to positioning devices generally and, more particularly, but not by way of limitation, to a novel, low-cost, linear positioning device.

2. Background Art

Linear positioning devices are employed in a wide variety of applications. An important example of such applications is in X-Y positioning devices used in such diverse applications as graph plotting and sailcloth cutting. Conventional linear positioning devices are characterized by relatively high cost of elements employed and high parts cost.

Accordingly, it is a principal object of the present invention to provide a linear positioning device which is economically to manufacture, yet provides relatively precise positioning.

It is a further object of the invention to provide such a linear positioning device that has low parts count.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a linear positioning device, comprising: a frame member; an electric motor disposed to selectively move axially back and forth in said frame member; carriage means attached to said electric motor; and means to guide said motor in axial movement and to prevent radial movement thereof. In a further aspect of the invention, there is provided a frame for a linear positioning device, comprising: a horizontal base plate; vertical end plates for attachment to ends of said base plate; said base plate including a first groove defined in the surface thereof for the mounting therein of a guide rail for a moving member; and said base plate is cut from an extrusion which includes said first groove, without the machining thereof. In another aspect of the invention, there is provided, in a linear positioning device, having the front end plate of an electric motor as an end plate of said device. In an additional aspect of the invention, there is provided, in a positioning device, having an electric motor fixedly mounted to an end plate of said device.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
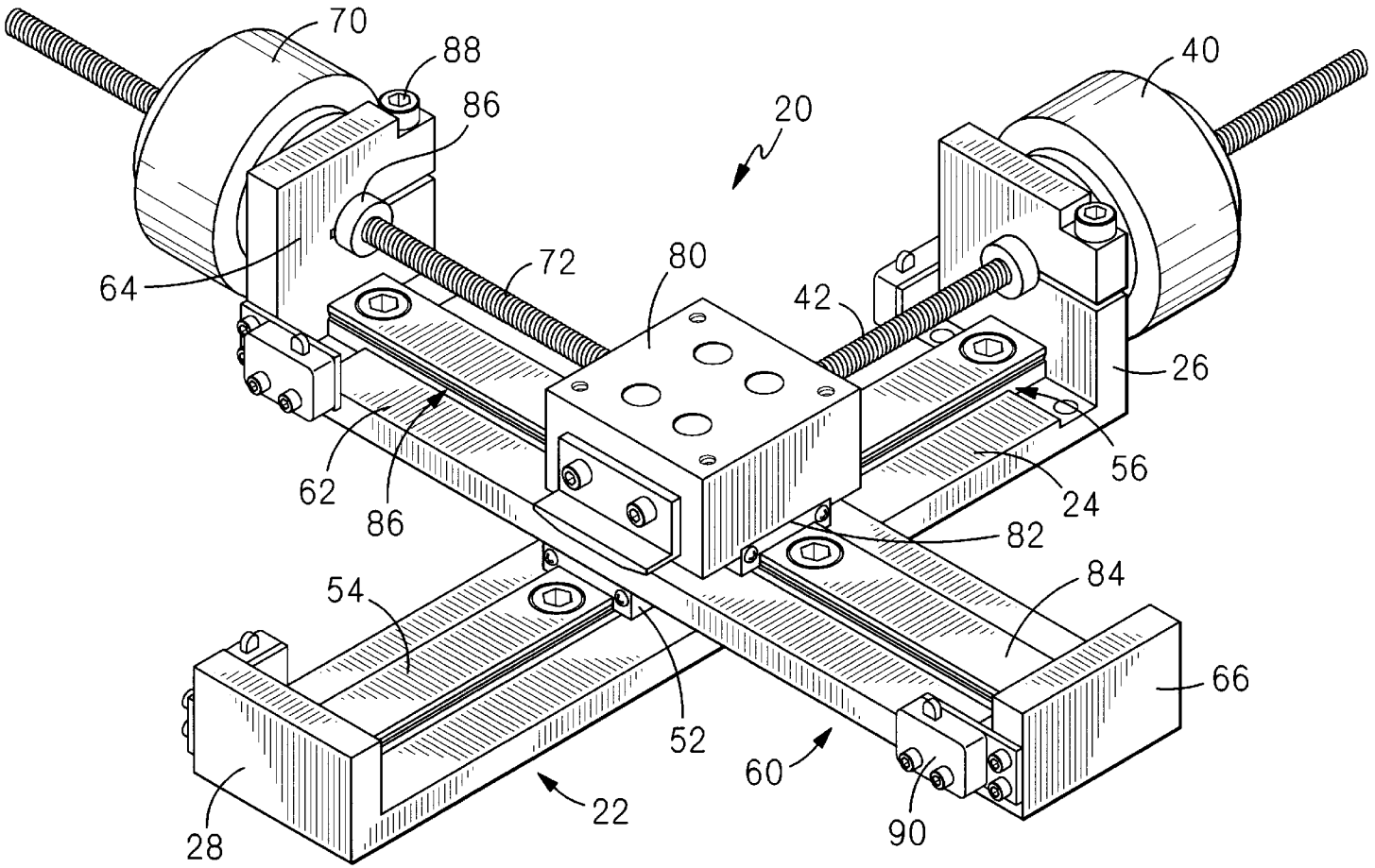
FIG. 1 (PRIOR ART)
FIG. 1 is an isometric view of an X-Y positioning device of conventional construction.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a conventional linear positioning device, generally indicated by the reference numeral 20. While device 20 is shown as being an X-Y positioning device, it will be understood that an X (back-and-forth only) positioning device would be of similar construction, with the omission of the Y stage thereof.

Device 20 includes a first, or X-stage, frame, generally indicated by the reference numeral 22, which is machined from a C-shaped channel of suitable material, such as aluminum. First frame 22 includes a horizontal base member 24 having first and second vertical end members 26 and 28 integral with and rising orthogonally from the ends of the base member. First end member 26 has mounted therein a first linear electric motor 40 having extending horizontally therethrough a first lead screw 42. The free end of first lead screw 42 extends outwardly from first motor 40. The opposite end of first lead screw 42 is fixedly attached to a horizontal base member 62 of a second, or Y-stage, frame, generally indicated by the reference numeral 60, for movement of the Y-stage back and forth in first frame 22 as first lead screw 42 moves axially in one direction and then the other. Horizontal base member 62 is mounted on a first linear bearing 52, of the recirculating ball type, which moves back and forth along a guide rail 54 inserted in a groove 56 defined in the upper surface of base member 24.

Second Y-stage frame 60 is similar to first X-stage frame 22. Second frame 60 is machined from a C-shaped channel of suitable material, such as aluminum. Horizontal base member 62 has first and second vertical end members 64 and 66 integral with and rising orthogonally from the ends of the base member. First end member 64 has mounted therein a second linear electric motor 70 having extending horizontally therethrough a second lead screw 72. The free end of second lead screw 72 extends from second motor 70 and device 20. The opposite end of second lead screw 72 is fixedly attached to a carriage block 80 for movement of the carriage block back and forth in second frame 60 as the first lead screw moves axially in one direction and then the other. Carriage block 80 is supported on a second linear bearing 82, of the recirculating ball type, which moves back and forth along a guide rail 84 mounted in a groove 86 defined in the upper surface of base member 62.

Second motor 70 is frictionally held in first end plate 64 of second frame 60 by means of clamping a resilient boss 86 on the face of the motor in the end plate by tightening a screw 88. First motor 40 has similar mounting means.

It will be understood that a tool, a workpiece, or the like (none shown) will be mounted on carriage block 80, with the carriage block selectively positionable or movable within a square, defined by the inner faces of first and second end plates 26 and 28 of first frame 22 and first and second end plates 64 and 66 of second frame 60, by the controlled axial movement of first and second lead screws 42 and 72. When device 20 is used as an X-positioning device, second frame 60 and the elements associated therewith would be omitted. Limit switches, as at 90, may be employed to terminate movement at extreme positions.

There are several disadvantages of conventional linear positioning devices, as exemplified by device 20.

(1) First and second frames 22 and 60, being machined parts, are labor intensive to produce and, consequently, relatively expensive. Also, since first and second frames 22 and 60 are machined from C-shaped channels, a range of sizes of the channels must be stocked by the manufacturer of the positioning devices to accommodate customers' different requirements. Custom manufacture can be difficult.

(2) The recirculating ball linear bearings employed are expensive.

(3) Having first and second lead screws 42 and 72 extend from device 20 is objectionable in many applications because of the space requirements.

(4) Device 20 has a high parts count.

(5) Motors 40 and 70 can back out of their mountings.

(6) Wiring for limit switches 90 is often exposed and/or requires special consideration for the protection thereof.

Figure 2:
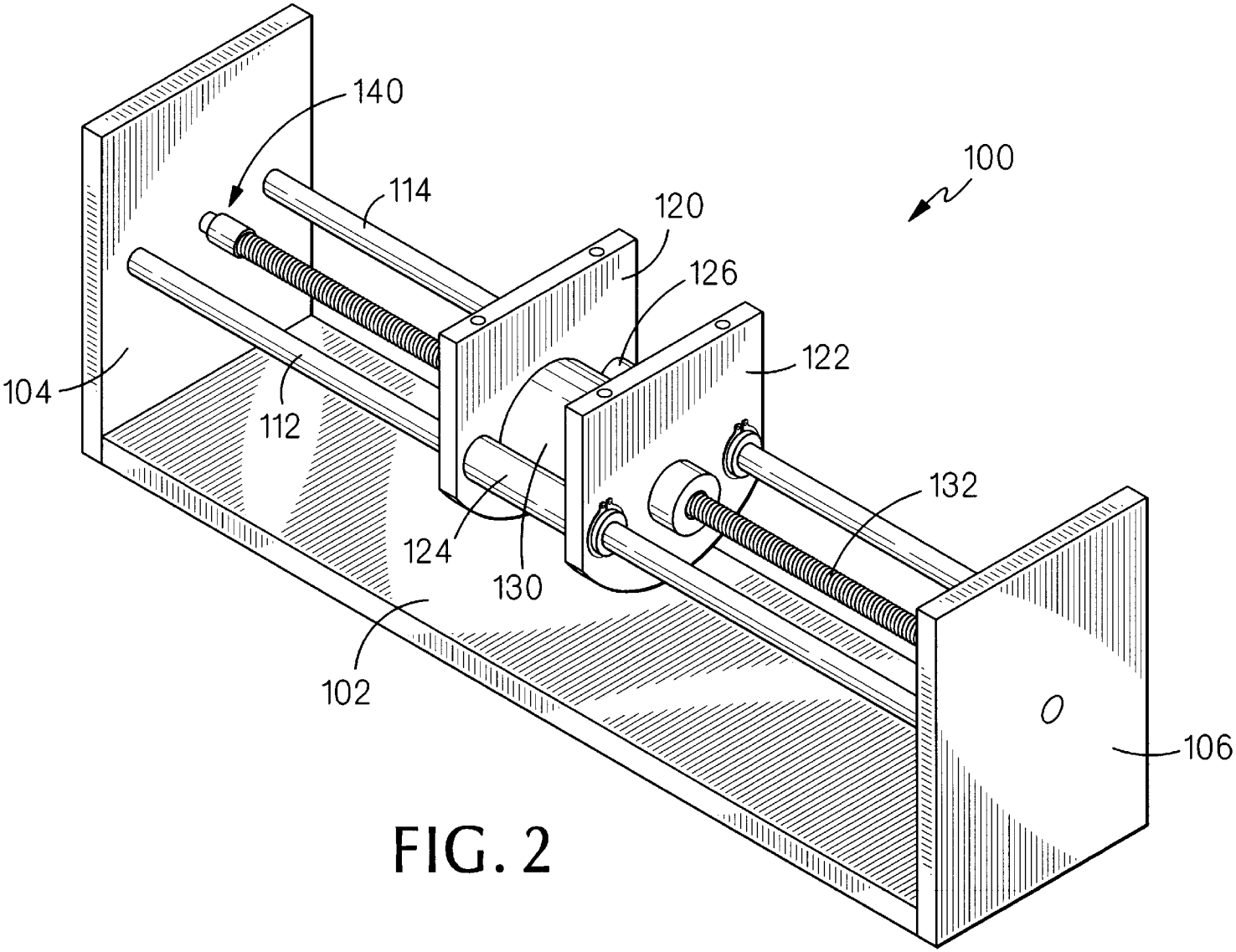
FIG. 2 is an isometric view of an X positioning device according to the present invention.

FIG. 2 illustrates an X positioning device, constructed according to the present invention, and generally indicated by the reference numeral 100.

Device 100 includes a horizontal base plate 102 having vertical first and second end plates 104 and 106 fixedly attached to the ends of the base plate by any suitable means and disposed orthogonally thereto. Fixedly attached between inner surfaces of first and second end plates 104 and 106 are spaced apart, horizontal, Teflon coated, guide rails 112 and 114, which may be as furnished by Kerk Motion Products, Inc., of Hollis, N.H. Two, vertical, spaced apart carriage plates 120 and 122 are mounted on guide rails 112 and 114 which are inserted through bushings 124 and 126, also furnished by Kerk Motion Products, Inc., fixedly attached to and disposed between the guide rails.

A rotary actuated linear electric motor 130 fixedly attached to and disposed between carriage plates 120 and 122 has a lead screw 132 threadedly journaled in the rotor (not shown) of motor 130, such that the motor and the carriage plates will selectively move back and forth along the lead screw as the motor rotor is rotated one direction or the other. Guide rails 112 and 114 guide motor 130 in axial movement and prevent radial movement thereof. A tool or other device to be positioned, or a Y-stage, may be attached to the upper surfaces of carriage plates 120 and 122. Alternatively, carriage plates 120 and 122 may be provided as the end plates of motor 130 for increased rigidity and further reduced parts count.

Figure 3:
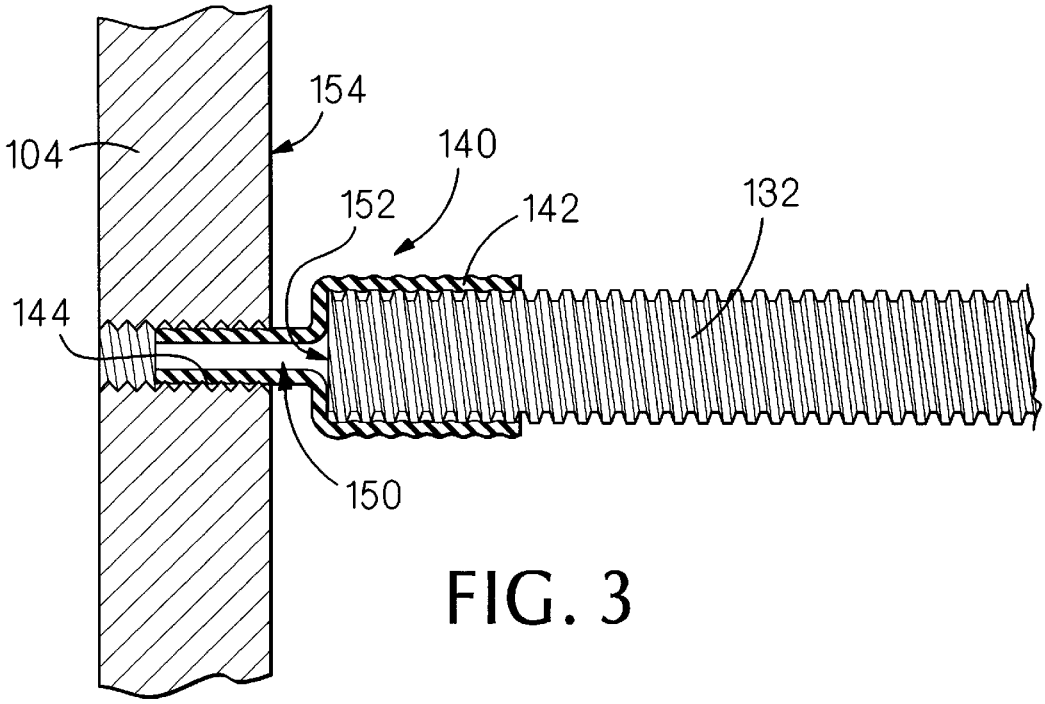
FIG. 3 is a side elevational view, partially in cross-section, of the means of mounting the free end of the lead screw of the embodiment of FIG. 2.

One end of lead screw 132 is fixedly attached to second end plate 106, while the other end of the lead screw is attached to first end plate 104 by means of a "soft" mounting, generally indicated by the reference numeral 140. The details of mounting 140 are seen by reference to FIG. 3. Mounting 140 includes a length of conventional shrink tubing 142 placed over the distal end of lead screw 132 and then the tubing is subsequently shrunk. The free end of tubing 142 is then rotatingly advanced into a horizontal threaded hole 144 defined in first end plate 104 so as to cut grooves in the outer surface of the tubing and secure the tubing in place. A gap 150 defined between the end face 152 of lead screw 132 and the inner surface 154 of first end plate 104 permits the portion of tubing 142 in that gap to flex in order to absorb installation and/or operational misalignment of the elements of device 100. If lead screw 132 were fixedly mounted to both first and second end plates 104 and 106, a flexible coupling would have to be provided in the lead screw.

Thus, device 100 is simply constructed and has low parts count. Base plate 102 and first and second end plates 104 and 106 may be cut from standard aluminum plate, with the base plate and guide rails 112 and 114 being easily cut to any desired length for a particular application. Lead screw 132 remains within the envelope defined by end plates 104 and 106. A Z-stage, as well as a Y-stage can be easily added to device 100.

Figure 4:
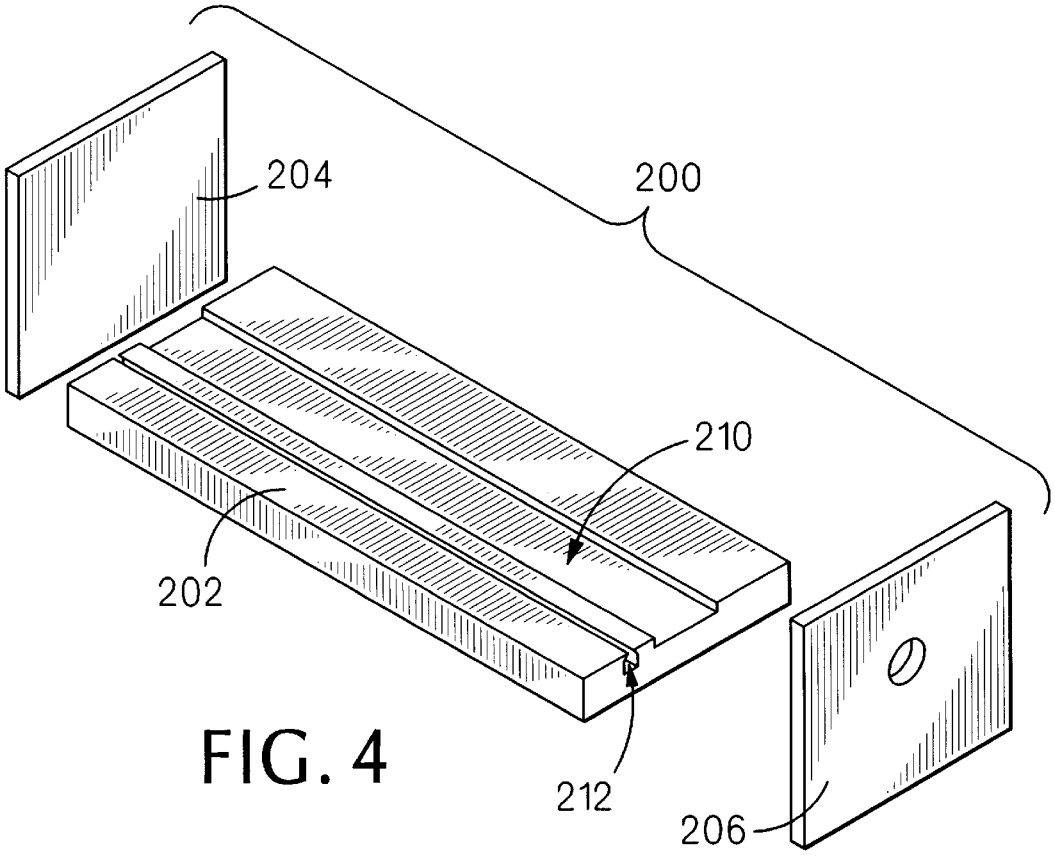
FIG. 4 is an exploded isometric view of a frame, useful in the present invention.
Figure 5:
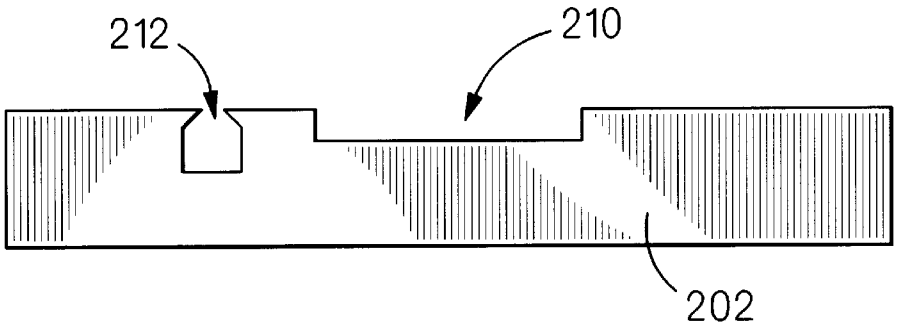
FIG. 5 is an end elevational view of the base of the frame of FIG. 4.

FIGS. 4 and 5 illustrate another aspect of the present invention, this being a frame for a linear positioning device of the type of device 20 (FIG. 1), the frame being generally indicated by the reference numeral 200. Frame 200 includes a base plate 202 and first and second end plates 204 and 206, with second end plate 206 being adapted for the mounting thereon of a motor (not shown). Base plate 202 is preferably cut from extruded aluminum stock and can thus be cut to any desired length. First and second end plates 204 and 206 may be attached to base plate 202 by any suitable conventional means. A first groove 210 (FIG. 5) is defined lengthwise in the upper surface of base plate 202 to accommodate therein a guide rail such as guide rail 54 (FIG. 1) and a second groove 212 is defined lengthwise in the upper surface of the base plate to accommodate therein electrical wiring associated with a linear positioning device (not shown). The electrical wiring would be encased in plastic tubing which would be snapped into second groove 212 by the elastic deformation of the tubing as it passes the upper, opposed edges of the second groove.

Thus, frame 200 can easily be provided in any desired length and is fabricated without having to perform any machining on the parts thereof.

Figure 6:
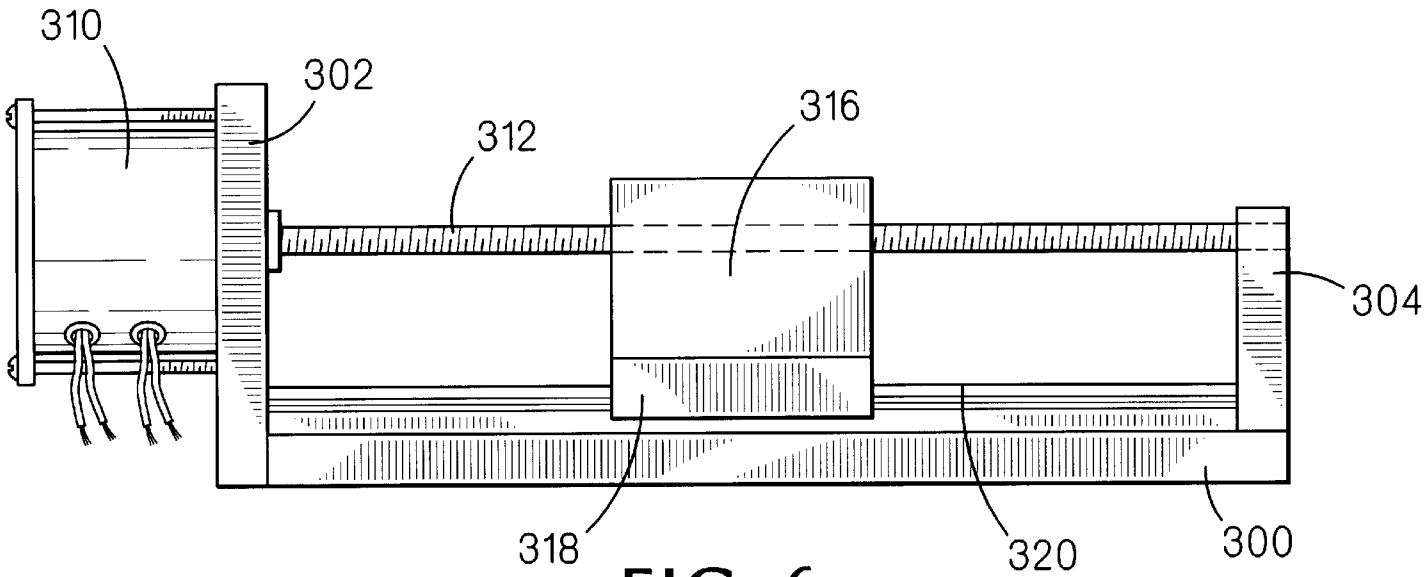
FIG. 6 is a side elevational view of an alternative embodiment of the present invention.

FIG. 6 illustrates another aspect of the present invention, in the form of a linear positioning device of the type of device 20 (FIG. 1). A horizontal frame base plate 300 has first and second vertical end plates 302 and 304. Mounted on first end plate 302 is an electric motor 310. A lead screw 312 extends between motor 310 and second end plate 304. Lead screw 312 is threadedly journaled in a carriage block 316 which is mounted on a linear bearing 318. Linear bearing 318 engages a guide rail 320 mounted on frame base plate 300 for back and forth movement therealong, as described above with reference to device 20.

The present invention provides first end plate 302 as the front end plate of motor 310, thus reducing parts count by one. Furthermore, as shown on FIG. 6, first end plate 302 is formed integrally with frame base plate 300, with second end plate 304 attached to the frame base plate. Thus, an L-shaped member can be stocked and cut to length as dictated by a particular application. Alternatively, first end plate 302 may be separately attached to frame base plate 300 or both the first end plate and second end plate 304 may be provided integrally with the frame base plate. Parts may be die cast or cut stock depending on the particular arrangement.

Figure 7:
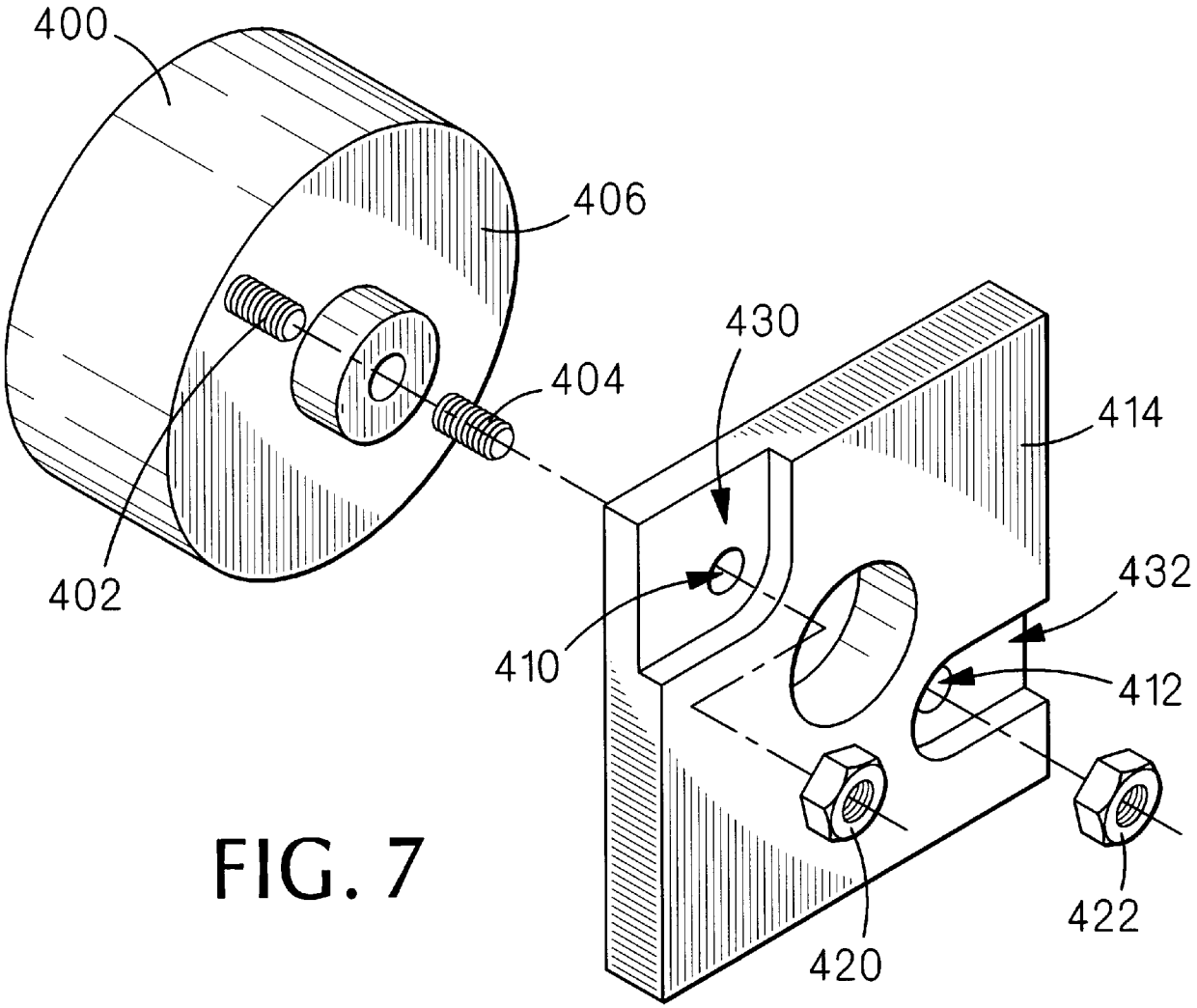
FIG. 7 is an isometric view of a method of mounting a motor to a plate, useful in the present invention.

As noted above with reference to FIG. 1, motor 70 is susceptible to backing out of first end plate 64. Motor 70, because of resilient mounting boss 86, is also susceptible to rotational and axial movement when in operation. A further aspect of the present invention provides a solid motor mounting as is shown on FIG. 7. Here, a motor 400 has two press-in, PEM-type, threaded studs 402 and 404 extending from the face of the end plate 406 of the motor. The distal ends of studs 402 and 404 extend, respectively, through holes 410 and 412 defined through a mounting plate 414 and the motor is fixedly attached to the mounting plate by means of nuts 420 and 422 threaded, respectively, onto studs 402 and 404. Recesses 430 and 432 are provided, respectively, in mounting plate 414 around holes 410 and 412 so that studs 402 and 404 and nuts 420 and 422 do not extend past the face of the mounting plate. This arrangement provides a rigid mounting for motor 400 and prevents rotational and axial movement thereof.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A linear positioning device, comprising:

(a) a frame member;

(b) an electric motor disposed to selectively move axially back and forth in said frame member;

(c) carriage means attached to said electric motor;

(d) means to guide said electric motor in axial movement and to prevent radial movement thereof; and (e) a lead screw disposed between ends of said frame member, said lead screw being threadedly journaled in a rotor of said electric motor, such that internal rotation of said electric motor causes said axial movement, without the use of a lead nut external to said electric motor.

2. A linear positioning device, as defined in claim 1, wherein: a first end of said lead screw is fixedly attached to a first end of said frame member and a second end of said lead screw is attached to a second end of said frame member by a resilient mounting member such that said resilient mounting member absorbs installation and operational misalignment of elements of said linear positioning device.

3. A linear positioning device, as defined in claim 1, wherein said means to guide comprises: at least one guide rail parallel to and spaced apart from said lead screw and extending through said carriage means.

4. A linear positioning device, as defined in claim 1, wherein: said carriage means comprises end plates of said electric motor.

5. A linear positioning device, comprising:

(a) a frame member;

(b) an electric motor disposed to selectively move axially back and forth in said frame member;

(c) carriage means attached to said electric motor;

(d) means to guide said electric motor in axial movement and to prevent radial movement thereof: and (e) a lead screw disposed between ends of said frame member, said lead screw being threadedly journaled in a rotor of said electric motor, such that internal rotation of said electric motor causes said axial movement, without the use of a lead nut external to said electric motor;

(f) a first end of said lead screw is fixedly attached to a first end of said frame member and a second end of said lead screw is attached to a second end of said frame member by a resilient mounting member; and (g) an end face of said second end of said lead screw is spaced apart from an opposing face of said second end of said frame member by said resilient mounting member.

6. A linear positioning device, comprising:

(a) a frame member;

(b) an electric motor disposed to selectively move axially back and forth in said frame member;

(c) carriage means attached to said electric motor;

(d) means to guide said electric motor in axial movement and to prevent radial movement thereof;

(e) a lead screw disposed between ends of said frame member, said lead screw being threadedly journaled in a rotor of said electric motor, such that internal rotation of said electric motor causes said axial movement;

(f) said lead screw having a first end thereof fixedly attached to a first end of said frame member and a second end thereof attached to a second end of said frame member by a resilient mounting member; and (g) said resilient mounting member comprising a length of heat shrink tubing shrunk over said second end of said lead screw and fixedly attached to said second end of said frame member, with a gap defined between an end face of said second end of said lead screw and an opposing face of said second end of said frame member.

7. A linear positioning device, as defined in claim 6, wherein: said heat shrink tubing is fixedly attached to said second end of said frame member by being rotatingly inserted into a threaded hole defined in said second end of said frame member such as to cut grooves in an outer surface of said heat shrink tubing.

* * * * *